US006257355B1

(12) United States Patent
Baker

(10) Patent No.: US 6,257,355 B1
(45) Date of Patent: Jul. 10, 2001

(54) DOWNHOLE POWER GENERATOR

(75) Inventor: Steven D. Baker, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/364,373

(22) Filed: Jul. 30, 1999

(51) Int. Cl.[7] ..... E21B 47/06
(52) U.S. Cl. ..... 175/50; 166/66.5
(58) Field of Search ..... 166/66.5, 65.1; 175/40, 50; 324/346, 345, 356, 369, 326, 324

(56) References Cited

U.S. PATENT DOCUMENTS 3,406,766 * 10/1968 Henderson ..... 175/50
3,731,752 * 5/1973 Schad ..... 175/45
4,110,688 * 8/1978 Bailey ..... 324/208
4,717,876 1/1988 Masi et al. .
5,485,089 * 1/1996 Kuckes ..... 324/346
5,839,508 11/1998 Tubel et al. .

FOREIGN PATENT DOCUMENTS 0 882 871 A2 12/1998 (EP) .

* cited by examiner

*Primary Examiner*—David Bagnell
*Assistant Examiner*—Zakiya Walker
(74) *Attorney, Agent, or Firm*—Steven L. Christian

(57) ABSTRACT

An apparatus and method contemplate the use of a downhole tool, at least one magnet, and a magnetic energy converter for generating electricity in a receiver positioned in a subsurface formation. The downhole tool is connected to a drilling or a logging assembly disposed in a wellbore. The magnet, which is attached to the downhole tool, generates a magnetic field extending into the formation. The magnetic energy converter, which is contained in the receiver located in the formation, is exposed to variations of the flux of the magnetic field generated by the magnet. These magnetic flux variations through the magnetic energy converter generate electricity in the receiver. The invention may be expressed in various embodiments that contemplate the use of pluralities of magnets arranged in different configurations.

56 Claims, 7 Drawing Sheets

DOWNHOLE POWER GENERATOR

BACKGROUND OF THE INVENTION

1. Field of the Invention

This invention relates generally to the drilling of deep wells such as for the production of petroleum products and more specifically concerns the supply of power to a remote receiver used to acquire subsurface formation data either while well drilling operations are in progress or during wireline logging.

2. Description of the Related Art

The oilfield service industry is currently attempting to measure more formation parameters while drilling. One method to achieve this objective is by the deployment in the formation of remote sensors. In order to collect and transmit data, these sensors must be either battery or remote powered. The main drawback of a battery-powered sensor is that its lifetime is relatively short, and once the battery is completely discharged, the remote sensor becomes useless.

Another solution is to transmit power to the sensor by using electromagnetic radio waves at high frequencies. In this case, one of the main difficulties is that while high frequency radio waves allow beam focusing through the formation, these radio waves are strongly attenuated by the formation fluids. In order to avoid the attenuation of these radio signals, it is preferable to use lower frequency radio waves. The problem then is that beam focusing becomes extremely difficult. Without beam focusing, the power emitted is radiated over a large volume instead of only toward the remote sensor and therefore, a large amount of the power emitted is lost. In order to compensate for this loss, the transmitter would have to be much more powerful.

For the foregoing reasons, there is a need for an apparatus and a method to remotely power a sensor located in a subsurface formation without being limited by a battery lifetime and without imposing unduly high power requirements on a downhole tool.

Accordingly, it is the general object of the present invention to provide a novel method and apparatus for remotely powering a receiver located in a subsurface formation.

It is an even further feature of the present invention to provide a novel method and apparatus for remotely powering a receiver without using electromagnetic radio waves to generate electricity.

It is still a further feature of the present invention to provide an apparatus which is simple in construction, yet effective to generate electricity in a receiver located in a subsurface formation.

SUMMARY OF THE INVENTION

These features and objects of the present invention, as well as others, are achieved by providing an apparatus which includes a downhole tool, at least one magnet and a magnetic energy converter. The downhole tool is connected to a drilling or a logging assembly disposed in a wellbore. The magnet, which is attached to the downhole tool, generates a magnetic field extending into the formation. The magnetic energy converter, which is contained in a receiver located in the formation, is exposed to variations of the flux of the magnetic field generated by the magnet. These magnetic flux variations through the magnetic energy converter generate electricity in the receiver.

In one embodiment of the invention, a plurality of magnets is aligned along an axis parallel to the axis of the downhole tool. The magnetic field so generated has field lines extending between each consecutive magnet and substantially located in planes which include the axis of the downhole tool.

In yet another embodiment of the present invention, a plurality of magnets are each located at the same distance from an upper section of the downhole tool. In this case, the magnetic field also has field lines extending between each consecutive magnet but these field lines are substantially located in planes perpendicular to the axis of the downhole tool.

The present invention also provides a method of generating electricity in a receiver located in the formation by generating a magnetic field extending into the formation where the energy converter in the receiver is located, and by varying the magnetic flux received by the energy converter in order to generate electricity.

DESCRIPTION OF THE DRAWINGS

So that the manner in which the present invention attains the above recited features, advantages, and objects can be understood in detail, a more particular description of the invention, briefly summarized above, is provided by reference to the preferred embodiments thereof which are illustrated in the accompanying drawings.

It is to be noted, however, that the appended drawings illustrate only typical embodiments of this invention and are therefore not to be considered limiting of its scope, for the invention may admit to other equally effective embodiments. In the drawings.

DETAILED DESCRIPTION OF THE PREFERRED EMBODIMENTS

Figure 1:
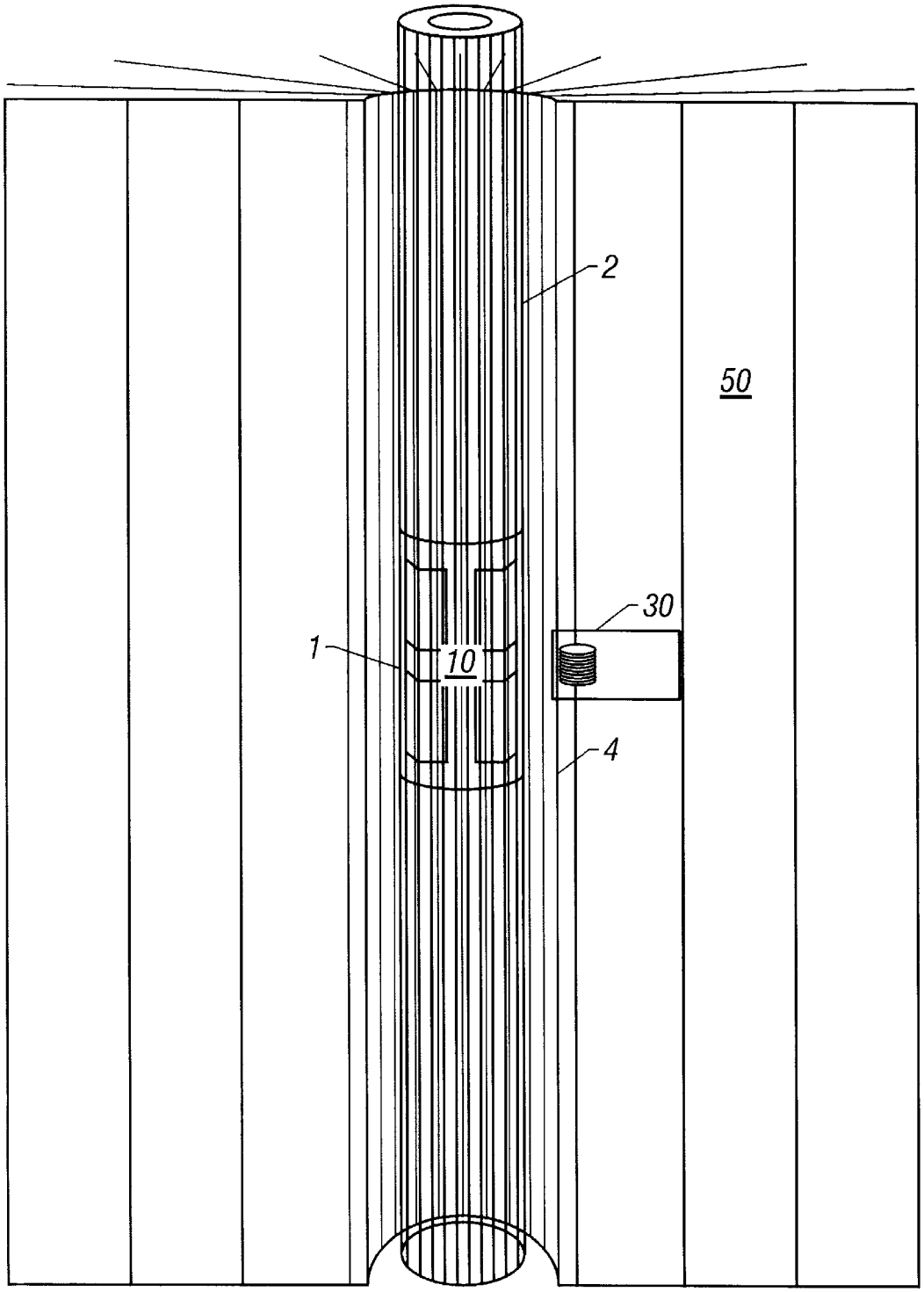
FIG. 1 is an elevational view of one embodiment of a downhole tool in accordance with the present invention connected to a drill string located in a formation.

Referring now to the various figures of the drawings wherein like reference characters refer to like parts, there is shown at reference numeral 1 in FIG. 1 an apparatus constructed in accordance with the instant invention and connected to a drilling string or assembly 2 located in a wellbore. This drilling assembly comprises elements well known to a person skilled in the art of the oil field service, including a drill bit (not shown), for creating a wellbore 4 that penetrates a subsurface formation 50. This apparatus 1 could also be connected to a wireline logging assembly and utilized to equal advantage. This apparatus is of particular utility in the oilfield service industry but can be also used in other applications involving the use of magnets for remotely generating electricity.

In the embodiment of the invention shown in FIG. 1, the apparatus 1 includes a downhole tool 10, several magnets attached to the downhole tool, and a receiver 30 located in the formation 50 and containing electronics which need to be electrically powered. The receiver 30 is indicated as a block, but preferably has the general shape of a bullet to facilitate deployment into the formation, and preferably is equipped for sensing one or more data parameters from formation 50, such as formation pressure and temperature. The magnetic field generated by the magnets extends into the formation and reaches the receiver. In the present invention, the magnets can be either permanent magnets, such as for instance Samarium Cobalt magnets, or electromagnets.

Figure 2:
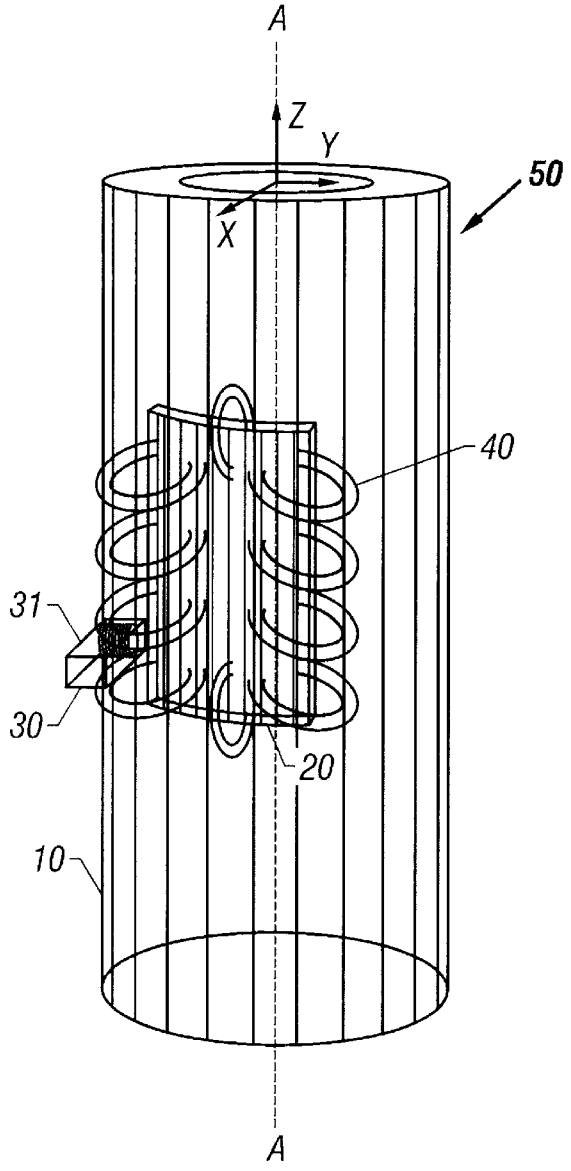
FIG. 2 is a perspective view of a second embodiment of the downhole tool with a magnet attached to it.
Figure 3:
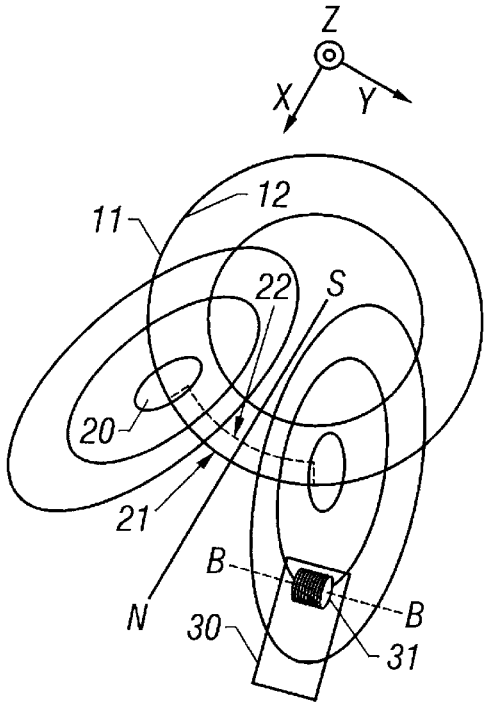
FIG. 3 is a plan view partially in section of the embodiment of the downhole tool shown in FIG. 2.

One embodiment of the invention in its simplest version is shown in FIG. 2 and FIG. 3. A magnet 20 is embedded in the drilling tool 10. The magnet generates a magnetic field 40 having field lines extending into the formation and reaching the receiver 30. These field lines extend from the North Pole of the magnet to its South Pole. The receiver 30 is located in the formation 50 and includes a magnetic energy converter 31 such as a coil.

Figure 4:
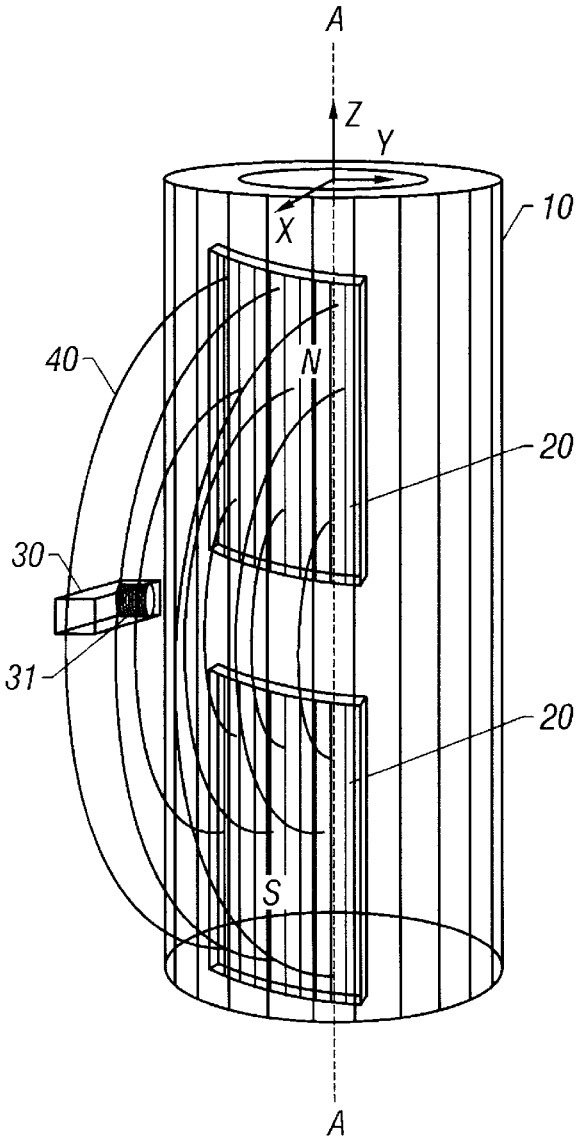
FIG. 4 is a perspective view of a third embodiment of the downhole tool having a pair of magnets attached to it and showing the field lines of the magnetic field extending between a pole of the first magnet and a pole of the second magnet and located in planes including the down hole tool's axis.
Figure 5:
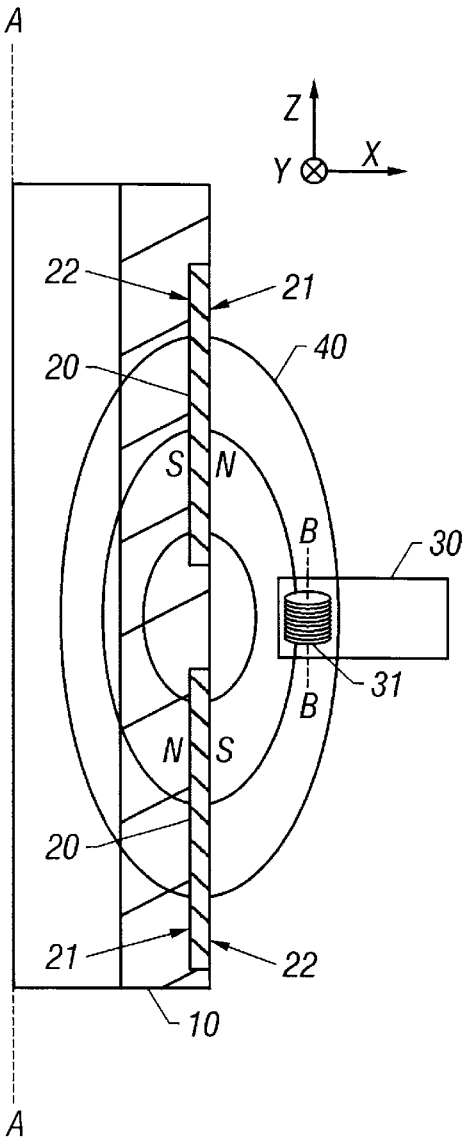
FIG. 5 is a partial, side elevational view, taken in section, of the embodiment of the downhole tool shown in FIG. 4.

Another embodiment of the invention is shown in FIG. 4 and FIG. 5. In this version of the invention, two magnets 20 are attached to the downhole tool to form a pair of magnets. This second magnet is aligned with the first magnet along a line which is parallel to the downhole tool's axis A—A. The two magnets have opposite polar orientation so that if for instance the South Pole of the first magnet is facing the axis of the downhole tool, then the North Pole of the second magnet will be facing the axis of the downhole tool. An opposite polar orientation to the one previously stated regarding the first and the second magnet is equivalent and has the same result. The separation between the two magnets is such that the magnetic field so generated will have field lines extending from a pole of the first magnet to a pole of the second magnet. It is well known to one skilled in the art that by convention, magnetic field lines extend from a North Pole of a magnet to a South Pole of a magnet and that magnetic field lines cannot intersect each other. In this embodiment of the invention, a substantial portion of the magnetic field lines 40 will be included in planes also including the axis A—A of the downhole tool. preferably, the length of the magnets 20 will be maximized in order to generate field lines extending deeply into the formation. In the case where permanent magnets will be used, the two magnets will be as thick as possible in order to increase the magnetic field intensity. Generally speaking, the use of longer and thicker magnets will allow generation of electricity in a receiver that is more deeply located in the formation further from the wall of the wellbore 4.

In order to improve the efficiency of the electricity generating apparatus, the coil 31 included in the receiver 30 will have a core made of a material having a magnetic permeability preferably much higher than the magnetic permeability of the air such as for instance a ferrite core. In the embodiment shown in FIG. 5, it will be preferred to have the axis B—B of the coil oriented perpendicularly to the axis of the receiver. It will also be preferred to have the axis B—B of the coil aligned so as to be substantially parallel to the axis A—A of the downhole tool.

In yet another embodiment of the invention not shown in the figures, several magnets 20 will be aligned along a line parallel to the downhole tool's axis A—A. In this version of the invention, either an even or an odd number of magnets could equally be used. A random disposition and a random polar orientation of the magnets along the line will enable the apparatus to generate electricity. However, to improve the efficiency of the apparatus, it is preferable to have each magnet along the line having an opposite polar orientation from its immediately following magnet on the line. For instance, in a line having N magnets, the nth magnet will have an opposite polar orientation from the (n−1)th and (n+1)th magnets. The line of magnets could start with a magnet having its North Pole or its South Pole facing the axis of the downhole tool. The separation between two consecutive magnets is such that the magnetic field so generated will have field lines extending from a pole of the first magnet to a pole of the second magnet. It is also preferable to have each magnet on the line separated by the same length.

Figure 6:
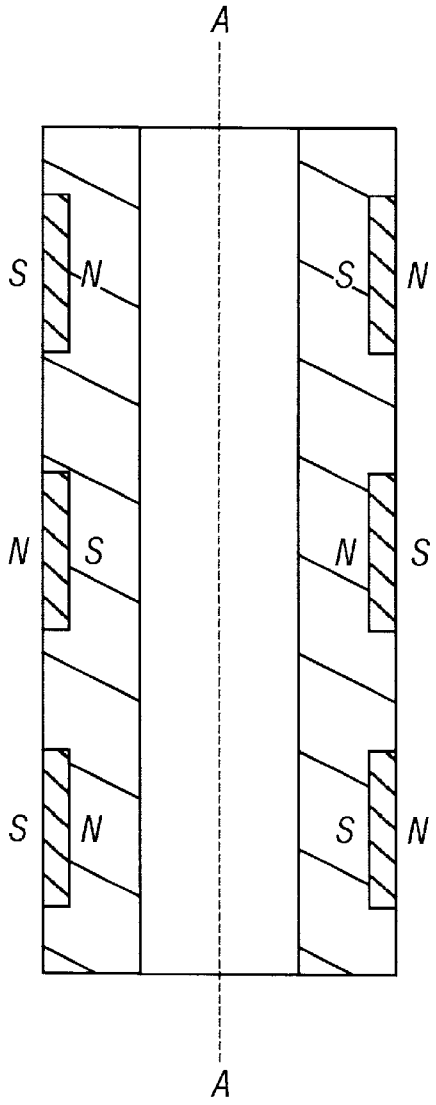
FIG. 6 is a side elevational view, taken in section, of a fourth embodiment of the downhole tool showing two lines of magnets having opposite polar orientation.

In another embodiment of the invention, a second line of magnets as previously described is placed on the downhole tool. The upper magnet of the first line of magnets and the upper magnet of the second line of magnets are located at the same distance from the upper section of the downhole tool. In other words, these upper magnets will be at the same elevation when the downhole tool is oriented vertically. Regardless of the number of lines of magnets added to the downhole tool, it is preferred to have them symmetrically located on the downhole tool. For instance, if two lines of magnets are used, it is preferable to have them diametrically opposed. If three lines of magnets are used, it is preferable that the upper magnets of the three lines of magnets are 120° apart. In these embodiments, it is possible to use lines of magnets having different polar orientation. For instance, in the case where two lines of magnets are used and as represented at FIG. 6, if the North Pole of the upper magnet of the first line is facing the axis of the downhole tool, then the South Pole of the upper magnet of the second line will be facing the axis of the downhole tool. Thus, each magnet of the first line will have a polar orientation which is the opposite of the polar orientation of each corresponding magnet of the second line.

Figure 7:
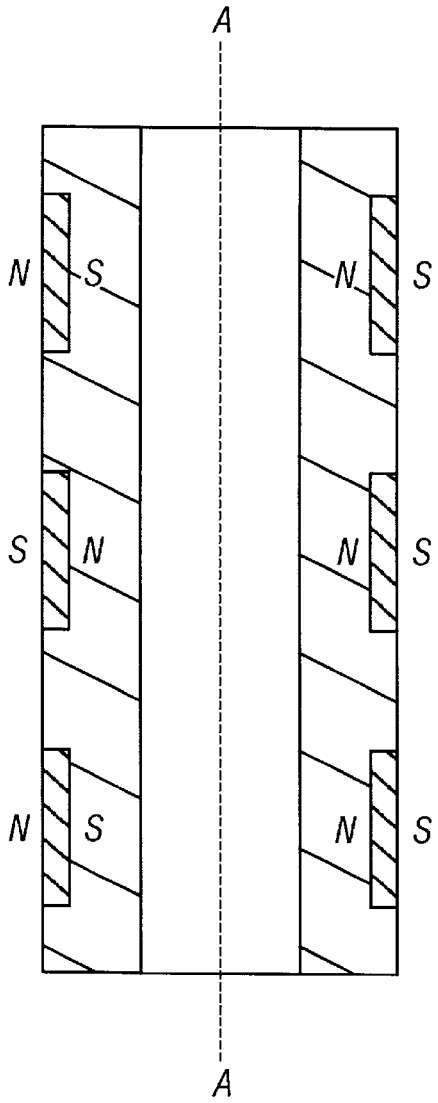
FIG. 7 is a side elevational view, taken in section, of a fifth embodiment of the invention showing two lines of magnets having identical polar orientation.

In other embodiments of the invention, several lines of magnets having similar polar orientations will be used. For instance and as shown in FIG. 7, in the case where two lines of magnets are used, if the South Pole of the upper magnet of the first line is facing the axis of the downhole tool, then the South Pole of the upper magnet of the second line will also be facing the axis of the downhole tool. Thus, the magnet lines will have polar orientations which are symmetric about the tool axis A—A. These embodiments have the advantage to prevent the formation of magnetic field lines lying in planes perpendicular to the downhole tool's axis.

Figure 8:
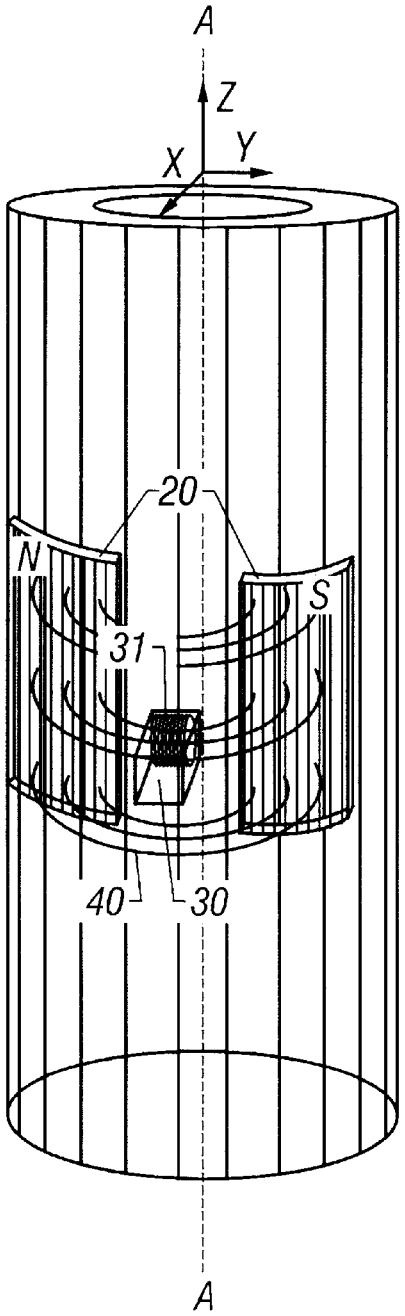
FIG. 8 is a perspective view of a sixth embodiment of the downhole tool having a pair of magnets attached to it, and showing the field lines of the magnetic field extending between a pole of the first magnet and a pole of the second magnet and located in planes perpendicular to the down hole tool's axis.
Figure 9:
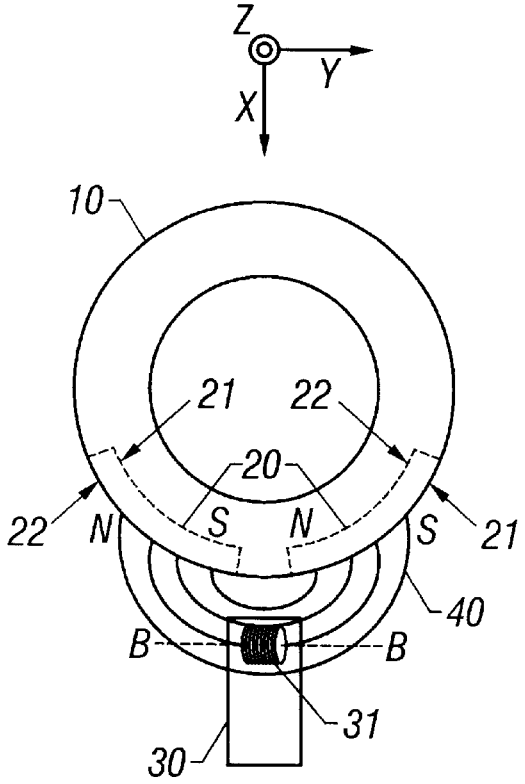
FIG. 9 is a plan view of the embodiment shown in FIG. 8

Another embodiment of the invention is shown in FIG. 8 and FIG. 9. In this version of the invention, a second magnet 20 is attached to downhole tool so that both the first and the second magnet are at the same distance from the upper section of the downhole tool. The two magnets have opposite polar orientation so that they generate a magnetic field 40 having field lines lying in planes perpendicular to the axis A—A of the downhole tool. In this embodiment, it will be preferred to have the axis B—B of the coil 31 perpendicular to the axis A—A of the receiver 30, as indicated in FIG. 9. It will also be preferred to have the axis of the coil being substantially perpendicular to the axis of the downhole tool.

Figure 10:
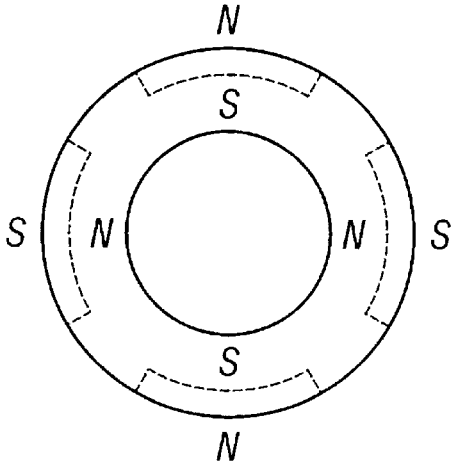
FIG. 10 is a plan view of a seventh embodiment of the invention having a ring of magnets.

In another version of the invention, several magnets are attached to the downhole tool and each of them is located at the same distance from the upper section of the downhole tool to form a ring of magnets. Several of such rings of magnets may be attached at varying distances from the upper section of the tool. Either an even or an odd number of magnets can be used. However, it is preferable to attach to the downhole tool an even number of magnets, which will include an equal number of magnets having opposite polar orientation. These magnets can be symmetrically located around the downhole tool. Each magnet with its own polar orientation will be positioned between two magnets having an opposite polar orientation as shown in FIG. 10.

Figure 11:
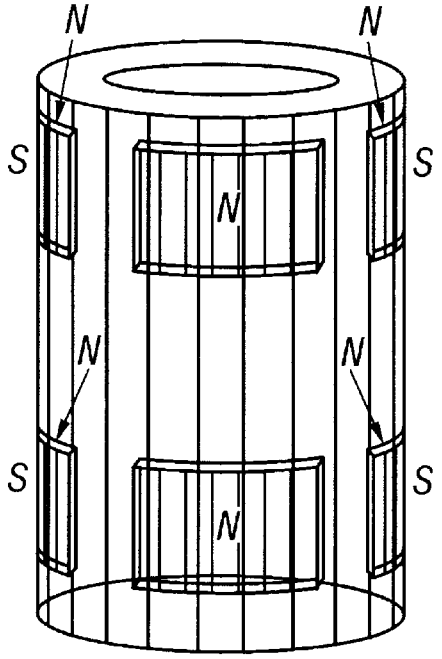
FIG. 11 is a perspective view of an eighth embodiment of the invention with two rings of magnets having an identical polar orientation.

In order to maximize the flux of the magnetic field through the coil of a receiver arranged as shown in FIGS. 8 and 9, it is desirable to have field lines lying as much as possible in planes perpendicular to the downhole tool's axis. Such a result can be achieved by having each ring of magnets sufficiently separated from the next ring of magnets so that the magnetic field generated will substantially be composed of field lines lying in planes perpendicular to the downhole tool's axis. It is also possible to use such separated rings of magnets having similar polar orientations as shown in FIG. 11. In this embodiment for instance, a magnet of the first ring has similar polar orientations as the corresponding magnet on the second ring, therefore preventing the generation of field lines lying in planes also including the downhole tool's axis.

Figure 12:
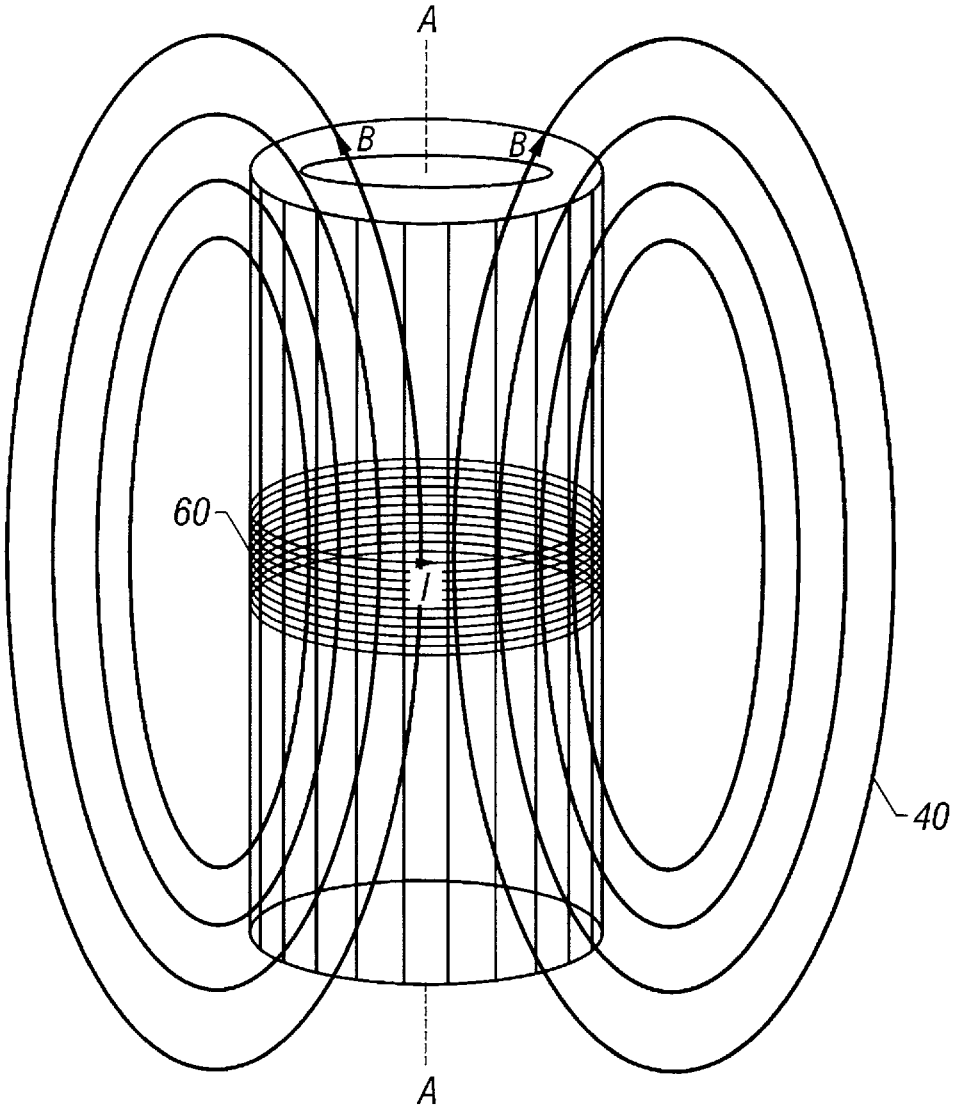
FIG. 12 is a perspective view of a ninth embodiment of the present invention having an electromagnet positioned circumferentially around the downhole tool.

In yet another embodiment of the invention, an electromagnet is used to generate a substantially symmetrical magnetic field, indicated by field lines 40, around the downhole tool. This electromagnet is composed of several turns of wire forming a coil 60 having the same axis A—A as the downhole tool as shown in FIG. 12.

This invention also relates to a method of generating electricity in a receiver located in a subsurface formation. As is well known to one skilled in the art, the principle of remote generation of electricity using magnets is based on Faraday's law. Faraday's law gives an induced electromotive force, EMF, according to the following equation:

$$EMF = \int \frac{\partial \overline{B}}{\partial t} \cdot d\bar{s}$$

where $\overline{B}$=magnetic flux density, and $d\bar{s}$=differentiated area through which $\overline{B}$ passes.

The method of this invention advantageously uses this general principle to generate electricity in the formation.

Figure 13:
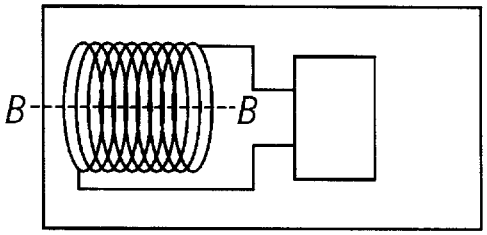
FIG. 13 is a schematic representation of one embodiment the receiver including a coil oriented along the axis of the receiver.
Figure 14:
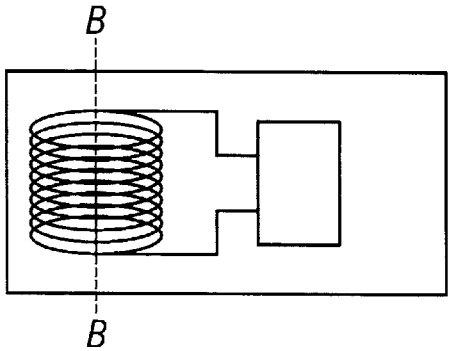
FIG. 14 is a schematic representation of a second embodiment of the receiver including a coil oriented perpendicularly to the axis of the receiver.

In its simplest version, the method includes the generation of a magnetic field that interacts with a magnetic energy converter located in a receiver which has been remotely positioned in a formation, and varying the magnetic flux resulting from the magnetic field interacting with the magnetic energy converter. The magnetic energy converter can comprise a core made of a material having high magnetic permeability, such as for instance ferrite, and enclosed in a coil made of several wire turns. The coil may be oriented in various configurations, as seen in FIGS. 13 and 14, to accommodate variations in the generated magnetic field lines. This magnetic energy converter is connected within the receiver to an electrical circuit to be powered. The circuit comprises, for instance, sensors positioned in the receiver for determining properties of the fluid present in the formation. The circuit may further include a transceiver for communicating data representative of such fluid properties, as is further described in copending U.S. application Ser. No. 09/019,466,filed Feb. 5, 1998,and 09/135,774, filed Aug. 18, 1998,both of which are commonly assigned to the assignee of this application. The magnetic energy converter will generate an AC voltage which can be rectified and filtered to obtain a DC voltage. The magnetic field needed can be generated by attaching a magnet to the downhole tool positioned in the wellbore, as described above in various embodiments.

In one embodiment of the invention, the magnetic field is constant over time. Such a result can be achieved by using for instance a permanent magnet. The magnet generates a magnetic field having field lines extending from its North Pole to its South Pole. A portion of this magnetic field penetrates the formation and is able to reach the magnetic energy converter in the receiver. Faraday's law indicates that any net variation (temporal or spatial) in the magnetic flux density passing through a surface results in an electromotive force. In this embodiment, the requisite variations of the magnetic flux are obtained by moving the magnet relative to the magnetic energy converter. Moving the magnet causes the magnetic field to move. Since the field has spatial variations, the surface bounded by a coil-turn in the magnetic energy converter is subjected to a net variation in intensity of magnetic field, and an EMF develops. As described in various embodiments above, the magnet may be moved relative to the energy converter by rotating the downhole tool substantially about its axis. Depending on the number of magnets attached to the downhole tool, it will be possible to subject the magnetic energy converter to multiple variations of the magnetic flux in one rotation of the downhole tool.

In other embodiments of the invention, the magnetic field varies over time. Such a result can be achieved by using for instance an electromagnet. In these embodiments, the needed variations of the magnetic flux through the magnetic energy converter are obtained either by varying the intensity of the current supplied to the electromagnet, by moving the magnet relative to this energy converter such as by rotating the downhole tool, or by performing both operations.

Variations in intensity of the current supplied to the electromagnet result in variations in intensity of the magnetic field. Once such variation is achieved by supplying the electromagnet with an AC current. Thus, it is possible to generate electricity in the receiver without moving the magnet relative to it.

In view of the foregoing, it is evident that the present invention is well adapted to obtain all of the objects and advantages herein above set forth, together with other objects and advantages which are inherent in the apparatus disclosed herein.

As will be readily apparent to those skilled in the art, the present invention may easily be produced in other specific forms without departing from its spirit or essential characteristics. The presently disclosed embodiments are therefore to be considered as merely illustrative and not restrictive. The scope of the invention is indicated by the claims that follow rather than the foregoing description, and all changes that come within the meaning and range of equivalents of the claims are therefore intended to be embraced therein.

What is claimed is:

1. Apparatus for generating electricity in a receiver located in a subsurface formation, the apparatus comprising:

a downhole tool having an upper end and a lower section, disposed in a wellbore penetrating the subsurface formation;

first magnet means for generating a magnetic field extending into the formation, the first magnet means being attached to the downhole tool; and a receiver remotely deployed in the formation and comprising a sensor for determining a property of the formation, a transceiver for communicating the determined formation property, and a magnetic energy converter, such magnetic energy converter being exposed to variations of the flux of the magnetic field generated by the magnet means to generate electricity for use by at least one of the sensor and the transceiver.

2. The apparatus of claim 1 further comprising:

at least a second magnet means for generating a magnetic field extending into the formation and being attached to the downhole tool.

3. The apparatus of claim 2 wherein:

the first and the second magnet means are positioned on the downhole tool so that they generate a magnetic field having field lines extending from a pole of the first magnet means to a pole of the second magnet means.

4. The apparatus of claim 3 wherein:

the first and the second magnet means are aligned along a line substantially parallel to the axis of the downhole tool and spaced to form a pair of magnet means for generating a magnetic field having field lines located in planes which include the axis of the downhole tool.

5. The apparatus of claim 4 further comprising:

a third magnet means located on the same line as the first and the second magnet means, the third magnet means generating a magnetic field having field lines extending from a pole of the third magnet means to a pole of the second magnet means.

6. The apparatus of claim 4 further comprising:

at least a second pair of magnet means located on the same line as the first pair of magnet means to form a first line of magnet means.

7. The apparatus of claim 6 further comprising:

at least one more magnet means located on the same line as all the pairs of magnet means.

8. The apparatus of claim 7 further comprising:

all the magnet means are separated from each other by the same length.

9. The apparatus of claim 8 further comprising:

at least a second line of magnet means.

10. The apparatus of claim 9 wherein:

the upper magnet means of the first line of magnet means and the upper magnet means of the second line of magnet means are located at the same distance from the upper end of the downhole tool.

11. The apparatus of claim 10 wherein:

the first and the second lines of magnet means, which form a pair of lines of magnet means, are diametrically opposed in the downhole tool whereby each magnet means of the first line of magnet means is facing a corresponding magnet means of the second line of magnet means.

12. The apparatus of claim 11 wherein:

each magnet means of the first line of magnet means has a polar orientation which is identical to the polar orientation of each corresponding magnet means of the second line of magnet means.

13. The apparatus of claim 12 further comprising:

at least a second pair of lines of magnet means.

14. The apparatus of claim 11 wherein:

each magnet means of the first line of magnet means has a polar orientation which is the opposite of the polar orientation of each corresponding magnet means of the second line of magnet means.

15. The apparatus of claim 14 further comprising:

at least a second pair of lines of magnet means.

16. The apparatus of claim 3 wherein:

the first and the second magnet means are each located at the same distance from the upper end of the downhole tool to form a pair of magnet means and spaced for generating a magnetic field having field lines located in planes perpendicular to the axis of the downhole tool.

17. The apparatus of claim 16 further comprising:

at least a second pair of magnet means located at the same distance from the upper end of the downhole tool as the first pair of magnet means to form a ring of magnet means.

18. The apparatus of claim 17 further comprising:

at least a second ring of magnet means located along the downhole tool.

19. The apparatus of claim 1 wherein:

the magnetic energy converter comprises a core made of a material having a magnetic permeability greater than the air and enclosed in a coil made of a plurality of wire turns.

20. The apparatus of claim 19 wherein:

the receiver is oriented in the formation such that the axis of the coil is parallel to the axis of the downhole tool.

21. The apparatus of claim 19 wherein:

the receiver is oriented in the formation such that the axis of the coil is perpendicular to the axis of the downhole tool.

22. Apparatus for generating electricity in a receiver located in a subsurface formation, the apparatus comprising:

a downhole tool having an upper end and a lower end disposed in a wellbore penetrating the subsurface formation;

a first magnet generating a magnetic field extending into the formation, the first magnet being attached to the downhole tool; and a receiver located in the formation and comprising a sensor for determining a property of the formation, a transceiver for communicating the determined formation property, and a magnetic energy converter, such magnetic energy converter being exposed to variations of the flux of the magnetic field generated by the magnet to generate electricity for use by at least one of the sensor and the transceiver.

23. The apparatus of claim 22 further comprising:

at least a second magnet generating a magnetic field extending into the formation and being attached to the downhole tool.

24. The apparatus of claim 23 wherein:

the first and the second magnet are positioned on the downhole tool so that they generate a magnetic field having field lines extending from a pole of the first magnet to a pole of the second magnet.

25. The apparatus of claim 24 wherein:

the first and the second magnet are aligned along a line substantially parallel to the axis of the downhole tool and spaced to form a pair of magnets generating a magnetic field having field lines located in planes which include the axis of the downhole tool.

26. The apparatus of claim 25 further comprising:

a third magnet located on the same line as the first and the second magnet, the third magnet generating a magnetic field having field lines extending from a pole of the third magnet to a pole of the second magnet.

27. The apparatus of claim 25 further comprising:

at least a second pair of magnets located on the same line as the first pair of magnet to form a first line of magnets.

28. The apparatus of claim 27 further comprising:

at least one more magnet located on the same line as all the pairs of magnets.

29. The apparatus of claim 28 further comprising:

all the magnets are separated each other by the same length.

30. The apparatus of claim 29 further comprising:

at least a second line of magnets.

31. The apparatus of claim 30 wherein:

the upper magnet of the first line of magnets and the upper magnet of the second line of magnets are located at the same distance from the upper end of the downhole tool.

32. The apparatus of claim 31 wherein:

the first and the second line of magnets, which form a pair of magnet means, are diametrically opposed in the downhole tool whereby each magnet of the first line of magnet means is facing a corresponding magnet of the second line of magnets.

33. The apparatus of claim 32 wherein:

each magnet of the first line of magnets has a polar orientation which is identical to the polar orientation of each corresponding magnet of the second line of magnets.

34. The apparatus of claim 33 further comprising:

at least a second pair of lines of magnets.

35. The apparatus of claim 32 wherein:

each magnet of the first line of magnets has a polar orientation which is the opposite of the polar orientation of each corresponding magnet of the second line of magnets.

36. The apparatus of claim 35 further comprising:

at least a second pair of lines of magnets.

37. The apparatus of claim 24 wherein:

the first and the second magnet are each located at the same distance from the upper end of the downhole tool to form a pair of magnets and spaced so that they generate a magnetic field having field lines located in planes perpendicular to the axis of the downhole tool.

38. The apparatus of claim 37 further comprising:

at least a second pair of magnets located at the same distance from the upper end of the downhole tool as the first pair of magnets to form a ring of magnets.

39. The apparatus of claim 38 further comprising:

at least a second ring of magnets located along the downhole tool.

40. The apparatus of claim 22 wherein:

the magnetic energy converter comprises a core made of a material having a magnetic permeability greater than the air and enclosed in a coil made of a plurality of wire turns.

41. The apparatus of claim 40 wherein:

the receiver is oriented in the formation such that the axis of the coil is parallel to the axis of the downhole tool.

42. The apparatus of claim 41 wherein:

the receiver is oriented in the formation such that the axis of the coil is perpendicular to the axis of the downhole tool.

43. The apparatus of claim 22 wherein:

the magnet is a permanent samarium cobalt magnet.

44. A method of generating electricity in a receiver located in a subsurface formation the method comprising:

generating a magnetic field that interacts with an energy converter in the receiver;

varying the magnetic flux through the energy converter and resulting from the magnetic field to generate electricity within the energy converter; and applying the electricity to a sensor disposed in the receiver for determining a property of the formation and a transceiver disposed in the receiver for communicating the determined formation property.

45. The method of claim 44 wherein:

the magnetic field is generated by attaching a magnet to a downhole tool positioned in a wellbore that penetrates the subsurface formation.

46. The method of claim 45 wherein:

the intensity of the magnetic field is constant.

47. The method of claim 46 wherein:

the magnetic flux through the energy converter is varied by moving the magnet relative to the energy converter.

48. The method of claim 47 wherein:

the magnet is moved relative to the energy converter by rotating the downhole tool substantially about its axis.

49. The method of claim 45 wherein:

the magnet is an electromagnet.

50. The method of claim 49 wherein:

the magnetic flux through the energy converter is varied by varying the intensity of the current supplied to the electromagnet thereby varying the intensity of the magnetic field generated by the electromagnet.

51. The method of claim 50 further comprising:

moving the electromagnet relative to the energy converter.

52. The method of claim 51 wherein:

the magnet is moved relative to the energy converter by rotating the downhole tool substantially about its axis.

53. The method of claim 51 wherein:

the magnet is moved relative to the energy converter by rotating the downhole tool where the magnet is attached.

54. The method of claim 49 wherein:

the magnetic flux through the energy converter is varied by supplying the electromagnet with an alternative current, thereby varying the intensity of the magnetic field generated by the electromagnet.

55. The method of claim 54 further comprising:

moving the magnet relative to the energy converter.

56. A method of generating electricity in a receiver located in a subsurface formation, comprising inducing a varying magnetic flux through an energy converter in the receiver to generate electricity within the energy converter and applying the electricity to a sensor disposed in the receiver for determining a property of the formation and a transceiver disposed in the receiver for communicating the determined formation property.

* * * * *